US006712693B1

(12) United States Patent
Hettinger

(10) Patent No.: US 6,712,693 B1
(45) Date of Patent: Mar. 30, 2004

(54) METHOD AND APPARATUS FOR PLAYER SELECTION OF AN ELECTRONIC GAME PAYOUT

(75) Inventor: Mark Hettinger, Las Vegas, NV (US)

(73) Assignee: IGT, Reno, NV (US)

( * ) Notice: Subject to any disclaimer, the term of this patent is extended or adjusted under 35 U.S.C. 154(b) by 319 days.

(21) Appl. No.: 09/650,866

(22) Filed: Aug. 28, 2000

(51) Int. Cl.[7] ..... A63F 9/24
(52) U.S. Cl. ..... 463/20; 463/25
(58) Field of Search ..... 463/13, 16, 20, 463/25, 26; 273/143 R, 139, 138.1

(56) References Cited

U.S. PATENT DOCUMENTS

| | | | | |
|---|---|---|---|---|
| 4,157,829 A | | 6/1979 | Goldman et al. | |
| 4,184,683 A | | 1/1980 | Hooker | |
| 4,648,600 A | | 3/1987 | Olliges | |
| 4,695,053 A | | 9/1987 | Vazquez, Jr. et al. | |
| 4,991,848 A | | 2/1991 | Greenwood et al. | |
| 5,106,091 A | | 4/1992 | Comito | |
| 5,123,649 A | | 6/1992 | Tiberio | |
| 5,154,421 A | | 10/1992 | Hamano | |
| 5,169,147 A | | 12/1992 | Hamano | |
| 5,265,880 A | | 11/1993 | Maksymec | |
| 5,364,105 A | | 11/1994 | Jones | |
| 5,393,061 A | | 2/1995 | Manship et al. | |
| 5,452,899 A | | 9/1995 | Skratulia et al. | |
| 5,494,287 A | * | 2/1996 | Manz | 273/143 R |
| 5,816,575 A | | 10/1998 | Keller | |
| 5,823,874 A | * | 10/1998 | Adams | 463/17 |
| 5,836,816 A | | 11/1998 | Bruin et al. | |
| 5,851,147 A | | 12/1998 | Stupak et al. | |
| 5,902,184 A | | 5/1999 | Bennett | |
| 5,908,353 A | | 6/1999 | Andrews | |
| 6,004,208 A | | 12/1999 | Takemoto et al. | |
| 6,022,022 A | | 2/2000 | Smith | |
| 6,059,289 A | | 5/2000 | Vancura | |
| 6,068,552 A | * | 5/2000 | Walker et al. | 463/21 |
| 6,558,253 B1 | * | 5/2003 | DeSimone et al. | 463/20 |
| 6,569,015 B1 | * | 5/2003 | Baerlocher et al. | 463/16 |

FOREIGN PATENT DOCUMENTS

EP 0420586 A2 * 4/1991 ..... G07F/17/34

* cited by examiner

*Primary Examiner*—Teresa Walberg
*Assistant Examiner*—Julie Brocketti
(74) *Attorney, Agent, or Firm*—Marshall, Gerstein & Borun LLP

(57) ABSTRACT

The present invention relates to a method and apparatus for providing the player of an electronically-controlled gaming device with greater control of selected parameters of the game. The value or frequency of occurrence of selected game elements or combinations of elements may be ranked or re-ranked from preset orders and/or values by a player of the gaming device to accommodate individual preferences as to winning elements or combinations of elements. The association and size of award payouts with certain elements or combinations may be varied. The microprocessor or other programmed controller for the gaming device automatically adjusts other parameters of the game in response to player input or adjustment of selected parameters to maintain a selected house advantage for the gaming device.

12 Claims, 7 Drawing Sheets

| Winning Combination | First Pay Schedule | Second Pay Schedule |
|---|---|---|
| Royal Flush Jackpot (5 coins bet only) | $3000 | $5000 |
| Royal Flush (up to 4 coins bet) | 600x | 1000x |
| Straight Flush | 50x | 50x |
| 4 of a Kind | 25x | 25x |
| Full House | 6x | 10x |
| Flush | 5x | 7x |
| Straight | 4x | 5x |
| 3 of a Kind | 3x | 3x |
| 2 Pair | 2x | 1x |
| Jacks or Better | 1x | 1x |

Fig. 1
(PRIOR ART)

METHOD AND APPARATUS FOR PLAYER SELECTION OF AN ELECTRONIC GAME PAYOUT

BACKGROUND OF THE INVENTION

1. Field of the Invention

The present invention relates generally to electronic and electro-mechanical games awarding a payout for performance based on skill, chance, or a combination of skill and chance. More particularly, the present invention provides an apparatus and method where a player of a game may select a plurality of winning combinations and rank them according to desired award amounts. A player may, alternatively or additionally, select the odds and associated awards for selected winning combinations, manipulate the odds that a winning combination will appear by adding elements of a winning combination to a group of elements, or weighting the elements which combine to form a winning combination heavier than other elements such that they appear more frequently.

2. State of the Art

Gambling or gaming machines and their operation are well known to those of ordinary skill in the art. Earliest embodiments of gaming machines took them form of mechanically-operated devices such as "slot machines" incorporating a series of spinning wheels, each bearing a sequence of symbols along its periphery indicating stop positions. Depending on which sequence of symbols randomly appeared in a viewing window along a win line, various prizes, credits or cash were awarded. Commonly, the appearance of a single symbol in a certain location (such as "cherries" on the first reel) might award a small amount, perhaps less than the amount bet by the player. A pair of the same symbol would pay slightly more. Three of that symbol would pay higher still. However, in the same device, the appearance of a different symbol, such as a "7" or "bar", might not pay anything for a single or pair, but three "7s" or "bars" might constitute a "jackpot" awarding the highest prize. The overall payout rate, and, thus, the house's profit or advantage, also known as "take," is determined by a set of "pay schedules," also known as "payout tables" or merely "pay tables" which rank, for example, winning combinations of symbols or hands of cards having a payout associated with each combination or hand in the ranking. The house's take is conventionally a percentage of the total cash or credit played at the gaming machine (e.g., three percent). The remainder of the money is returned to the players through winnings to encourage further play, thereby sustaining and increasing the house's overall take over a period of time. In conventional electronic gaming machines, the game "personality", the odds and payout schedule, which is comprised of symbol odds and award amounts stored in memory, determines the theoretical payouts.

FIG. 1 illustrates examples of two pay schedules which may be used by an exemplary, conventional electronic card game known in the art, wherein Nx (N being an integer) is used to indicate the award as a multiplier of the number of coins bet if the winning combination appears. As should be clear to one of ordinary skill in the art by viewing the two pay schedules, the First Pay Schedule is skewed to award some relatively higher payouts for more common hands, while the Second Pay Schedule is skewed to award relatively higher payouts for less common hands.

Gaming machines may also limit the highest jackpot to those who wager the maximum number of credits for each play, often three to five credits (see FIG. 1, Royal Flush Jackpot) but conventionally far in excess of that range, in some instances fifteen or more credits and, as known to the inventor herein, as many as 135. A credit may take the form, by way of example and not limitation, of a coin, a token or an electronically-recorded account entry. For convenience and clarity, all such wagers and awards will be referred to herein as "credits". As shown, the highest obtainable jackpot is often proportionately exaggerated in comparison to jackpots which can be won by betting less than the highest number of credits allowed per play. As an additional example, a single credit bet might yield a highest jackpot of 100 credits. Two credits bet might yield a highest jackpot of 200 credits. However, three credits bet (in a three credit maximum bet device) might yield a possible jackpot of 1000 credits.

Gaming devices controlled by microprocessors are well known in the art, the devices using either mechanical spinning reels or animated video displays of reels, cards, Keno boards and the like. The emergence of such electro-mechanical and purely electronic devices has opened a vast array of possibilities to gaming device designers. One such innovation has been to interconnect banks of gaming devices, both locally and over broad geographic areas, with a relatively small percentage of each wager being cumulatively added to a centralized and ever-growing jackpot. Such an arrangement is known as a multi-link progressive jackpot. One state-wide progressive jackpot is the Megabucks® program operated by International Gaming Technology throughout the State of Nevada.

U.S. Pat. No. 5,154,421 to Hamano (Oct. 13, 1992) and U.S. Pat. No. 5,169,147 to Hamano (Dec. 8, 1992) disclose mechanical rotary gaming devices with associated microprocessors, this arrangement being conventionally used in the form of a modem slot machine, and a method for allowing an owner of the devices to control the stop action of the rotary units to adjust the probability of appearance of the displayed symbols. As a further example, U.S. Pat. No. 4,448,419 to Telnaes (May 15, 1994) describes a mechanical reel slot machine controlled by a microprocessor in such a way as to manipulate and vary the odds of achieving any particular combination of symbols through the use of a random number generator picking numbers representing stop positions, each stop position being represented by one or more numbers so as to control the frequency of occurrence. The scheme creates a "virtual reel" within the microprocessor even though a physical reel is used to display the game outcome symbols.

FIG. 2 is a block diagram of an exemplary electronic game 102 as found in the art. An electronic game 102 typically includes a microprocessor or other computer 104 having a central processing unit ("CPU") 106 and memory 108. The computer may be coupled to a number of peripheral devices such as, by example only, a display 110 (e.g., a cathode ray tube ("CRT"), plasma display, liquid crystal display ("LCD"), and/or a display based on light-emitting diodes ("LED")), possibly having a touchscreen input 112 (see U.S. Pat. No. 5,951,397 to Dickinson (Sep. 14, 1999)), and/or buttons, keys or other manual input devices 114. Preferably a credit acceptor device 116 (to accept coins, currency, credit cards, gaming cards, smart cards and the like) permits a player to activate game play or place wagers. The electronic game may also include a separate scoreboard display 118.

Electronic games may also be coupled to one or more other computers such as a central computer 120 of a casino, e.g., via a network card 122 and link 124, a modem 126 and the like. The game parameters 128, such as how, when and where particular images will appear on the display screen 110, how the game works and how to operate the various elements operably coupled to the computer 104, are-stored in the memory 108. The electronic game 102 may be housed in a game housing such as, by example only, those shown in U.S. Pat. No. 5,820,460 to Fulton (Oct. 13, 1998) and Des. U.S. Pat. No. 404,436 to McGahn et al. (Jan. 19, 1999).

Initiating an electronic game can be done as simply as by inserting a credit or, more comprehensively, for example, by inserting an identification card, such as a "smart card" having a programmed microchip or a magnetic strip coded with a player's identification and credit totals. See U.S. Pat. No. 5,265,874 to Dickinson et al. (Nov. 30, 1993). U.S. Pat. No. 5,806,045 to Biorge et al. (Sep. 8, 1998) uses a writeable identification card, such as a "smart card" to eliminate the need for a network or direct connection between remote systems and a common controller or point database. Credit and other information may be retrieved, recorded and updated using the "smart card." Alternatively, it is known to transfer money to a game through an electronic funds transfer as described in U.S. Pat. No. 5,902,983 to Crevelt et al. (May 11, 1999).

Electronic gaming devices, such as those conventionally found in a casino, are widely diverse in structure, and their operation and manufacture are well known to those of ordinary skill in the art. For gaming devices such as the aforementioned Megabucks® games, a higher potential payout encourages players to play the game and continue playing the game. Many other gaming devices are also designed to encourage prolonged and repeated play of the device. Understandably, the more a gaming device is played, the greater the house's volume of profit or take from the game.

One method presently used in the art to make a gaming device more interesting and entertaining is to allow players to choose a pay schedule, either directly or through their actions, for a predetermined set of combinations from an established set of pay schedules. One example of this may be found in U.S. Pat. No. 5,123,649 to Tiberio (Jun. 23, 1992). Tiberio discloses a slot machine having a dynamic pay schedule wherein the slot machine selects a pay schedule from a set of pay schedules as a function of the number of credits applied and the current state of the machine. The current state of the machine is represented by an event counter incremented upon the happening of certain events. As the machine counter advances from one state to the next, pay schedules of successively higher rank are selected so that the player's potential payout increases.

Another example of player-selected pay schedules is disclosed in U.S. Pat. No. 5,851,147 to Stupak et al. (Dec. 22, 1998). The device of Stupak et al. includes pay schedules from which a player may select an active pay schedule. The selectable pay schedules include pay schedules which offer an increased potential payout for combinations with a higher probability of appearing by decreasing the potential payout for those combinations with a lower probability of appearing. Stupak et al. also disclose selectable pay schedules which offer an increased potential payout for combinations with a lower probability of appearing by decreasing or eliminating the payout for those combinations with a higher probability of appearing. Stupak et al. even disclose a pay schedule wherein all payouts are eliminated except for a large payout on the combination having the lowest probability of appearing (a Royal Flush).

U.S. Pat. No. 5,902,184 to Bennett (May 11, 1999) discloses predetermined pay schedules selectable by a player based upon a range from which a player would like a variable, random prize to be awarded. Once a player chooses the range from which the variable prize will come, the associated pay schedule is displayed. Thus, a player may take a risk of a lower routine payout in exchange for the possibility of a high variable payout, or a higher routine payout in exchange for a low variable payout.

Another method presently used in the art to make a gaming device more interesting and entertaining is to allow players to choose a particular winning combination for which the gaming device will pay out. With slot machines, as demonstrated by U.S. Pat. No. 4,184,683 to Hooker (Jan. 22, 1980), U.S. Pat. No. 4,648,600 to Olliges (Mar. 10, 1987) and U.S. Pat. No. 4,695,053 to Vazquez, Jr. et al. (Sep. 22, 1987), it is known to allow a player to select one winning combination or symbol for which the slot machine will pay. For electronic card games, as demonstrated by U.S. Pat. No. 5,452,899 to Skratulia (Sep. 26, 1995), U.S. Pat. No. 5,816,575 to Keller (Oct. 6, 1998) and U.S. Pat. No. 6,022,022 to Smith (Feb. 8, 2000), it is known to allow a player to select a winning set of cards or a particular card for which the game will pay. There are also other gaming devices where a player may select one particular symbol, number, letter, ball, or combination thereof, as the trigger for the gaming device to pay out. See U.S. Pat. No. 5,106,091 to Comito (Apr. 21, 1992), U.S. Pat. No. 5,265,880 to Maksymec (Nov. 30, 1993) and U.S. Pat. No. 5,836,816 to Bruin et al. (Nov. 17, 1998).

In each of the slot machines, electronic card games and other games discussed above, the respective amounts of the pay schedule awards are proportional to the odds of achieving the particular combination or symbol selected. In other words, for a particular pay schedule among the pay schedules available for player selection, those elements or combinations with a lower probability of appearing have a higher associated payout than those elements or combinations with a higher probability of appearing. Thus, payout amounts are ranked strictly by the probability of achieving a particular combination. Additionally, where a player is permitted to select a winning element or combination, the player is only permitted to select one element or combination for the award. In this way, players are limited in their available options for playing existing gaming devices which may also limit their entertainment and interest in the game. It is, therefore, desirable to allow players more control over pay schedules and game variations to increase player interest in the games.

BRIEF SUMMARY OF THE INVENTION

The present invention relates to a method and apparatus for providing the player of an electronically-controlled gaming device greater control of selected parameters of the game. In a first aspect of the present invention, a game may be configured to allow a player to rank player-selected winning combinations regardless of the probability for the particular combination appearing. By reducing the possible payout available for elements or combinations with a low probability of appearance, the possible payout for elements or combinations with a higher probability of appearance may be increased. The player may select and rank the winning combinations from a predetermined list of combinations, or the player may select, create and rank winning combinations from a list of elements. Thereafter, a processor associated with the apparatus generates an appropriate set of payouts for the pay schedule responsive to the player-selected combination rankings in order to maintain a desirable, or legally-mandated, overall payout for the game.

In a second aspect of the invention, a gaming device may be configured such that a player may adjust the odds of appearance of a particular game element or winning combination of elements. By adjusting the odds of a particular element or combination appearing, a player may also increase the level of interest the player has in the game by seeing selected elements or combinations more often than others. In one embodiment, the odds of appearance may be adjusted by the player directly adjusting the weight assigned to various elements in the game. In another embodiment, the odds of appearance may be adjusted by the player adding additional elements to the game or increasing or reducing the number of particular elements available from which to make combinations. In yet another embodiment, a player assigns the odds for achieving predetermined or player-selected elements or sets of combinations. As with the first aspect of the invention, pay schedules may be generated by an associated microprocessor responsive to player input.

In a third aspect of the invention, a player may select one or more award amounts for predetermined or player-selected winning elements or combinations. Once a player has entered an amount or amounts for which the player wishes to play with respect to a given element or combination or several elements or combinations, a microprocessor associated with the game may create (i.e., adjust) payouts of the pay schedule to accommodate the selected awards.

Various combinations of the aforementioned aspects of this invention are described further in detail hereafter. As one of ordinary skill in the art will understand, numerous combinations of these aspects are possible, and those provided are for illustrative and exemplary purposes only and are not in any way limiting to the present invention.

BRIEF DESCRIPTION OF THE SEVERAL VIEWS OF THE DRAWINGS

The nature of the present invention, as well as other embodiments of the present invention, may be more clearly understood by reference to the following detailed description of the invention, to the appended claims, and to the several drawings herein, wherein:

FIG. 1 is a table including two examples of prior art pay schedules;

DETAILED DESCRIPTION OF THE INVENTION

Figure 2:
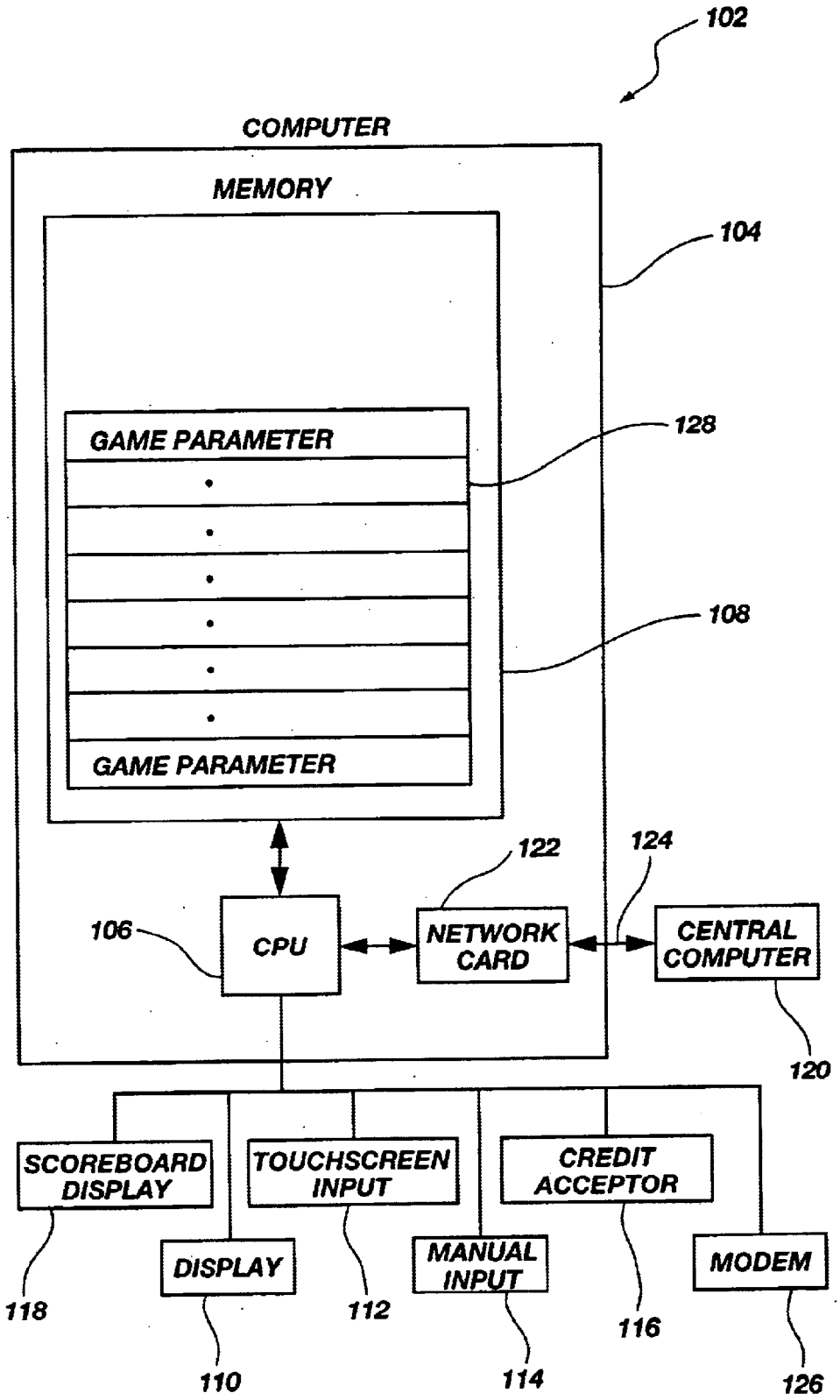
Fig. 2 (PRIOR ART)
FIG. 2 is block diagram of a prior art electronic game.
Figure 3:
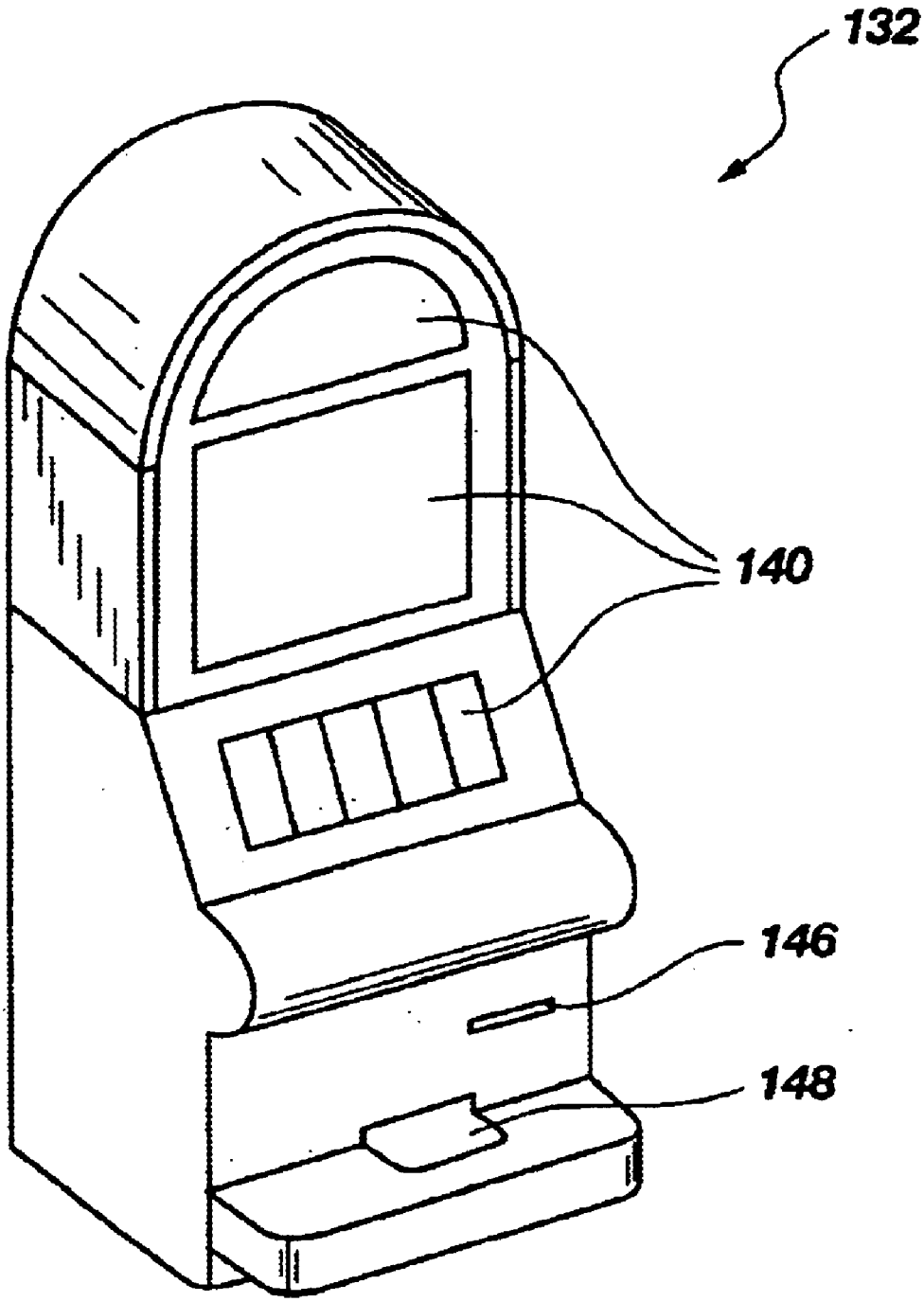
FIG. 3 is an embodiment of an electronic game including a display such as may be used in conjunction with the present invention.

FIG. 3 illustrates a block diagram of an exemplary electronic game according to the present invention. Like prior art electronic games, the electronic game 132 of FIG. 3 includes a microprocessor or other computer or controller having a central processing unit ("CPU") and memory, all as previously described herein with respect to FIG. 2. Similarly, the computer of the electronic game 132 of FIG. 3 may be coupled to a number of peripheral devices such as, by way of example only, one or more displays 140, one of which possibly having a touchscreen input, a credit acceptor device 146 and a coin return 148. Furthermore, like prior art electronic games, the electronic game 132 of FIG. 3 may also be coupled to one or more other computers, such as a central controller of a casino through a network card and link, modem and the like. Distinct from the prior art are the game parameters and display, the game parameters of the present invention including programming to allow a player enhanced control over pay schedules and winning combinations and to display the results of such enhanced control. As used herein, the term "electronic game" may, in appropriate instances, include electromechanical games structured and operable in accordance with the present invention. Also, as previously noted, the credits tendered by a player and paid out by a gaming machine according to the present invention may comprise coins, tokens or electronically-recorded account entries, the latter of which when awarded may be printed on tickets for redemption at a cashier, as known in the art. In a random environment, such as that modeled by a microprocessor of an electronic game of chance, the odds or probability (P) that a particular element will appear is equal to the quantity (q) of that element divided by the total number of elements available (T). In other words, $P=q/T$. By simple example, in a standard deck of 52 cards, the odds of drawing the Queen of Hearts is 1/52, or approximately 1.923%. Respectively, the odds of drawing a Queen of any suit is 4/52, or approximately 7.69%, because there are four Queens.

For combinations of elements, the odds of a particular combination of elements appearing is the product of the odds for each element in the combination appearing. Thus, for a combination including all four Queens appearing, the odds are $1/52*1/51*1/50*1/49$, or approximately 0.00001539%. The denominator in each fraction used is decreased sequentially by one for each card in the combination because one card was sequentially removed from the deck for each card placed in the combination.

It is by calculating these probabilities of elements and combinations and determining the total payout based on the probabilities of all winning combinations that pay schedules are generated. Microprocessors and associated software are readily available and well known in the art of gaming machines for generating pay schedules given total available elements, winning combinations thereof and the house take.

According to a first aspect of the present invention, a player desiring to play an electronic gaming machine is prompted, for example and not by way of limitation, by the wagering of one or more credits at the machine, to rank desired winning combinations in an order not necessarily related to the probability of obtaining such winning combination. After the player has ranked the winning combinations, a processor associated with the game generates appropriate payouts for the combinations of the pay schedule as ranked.

Figure 4:
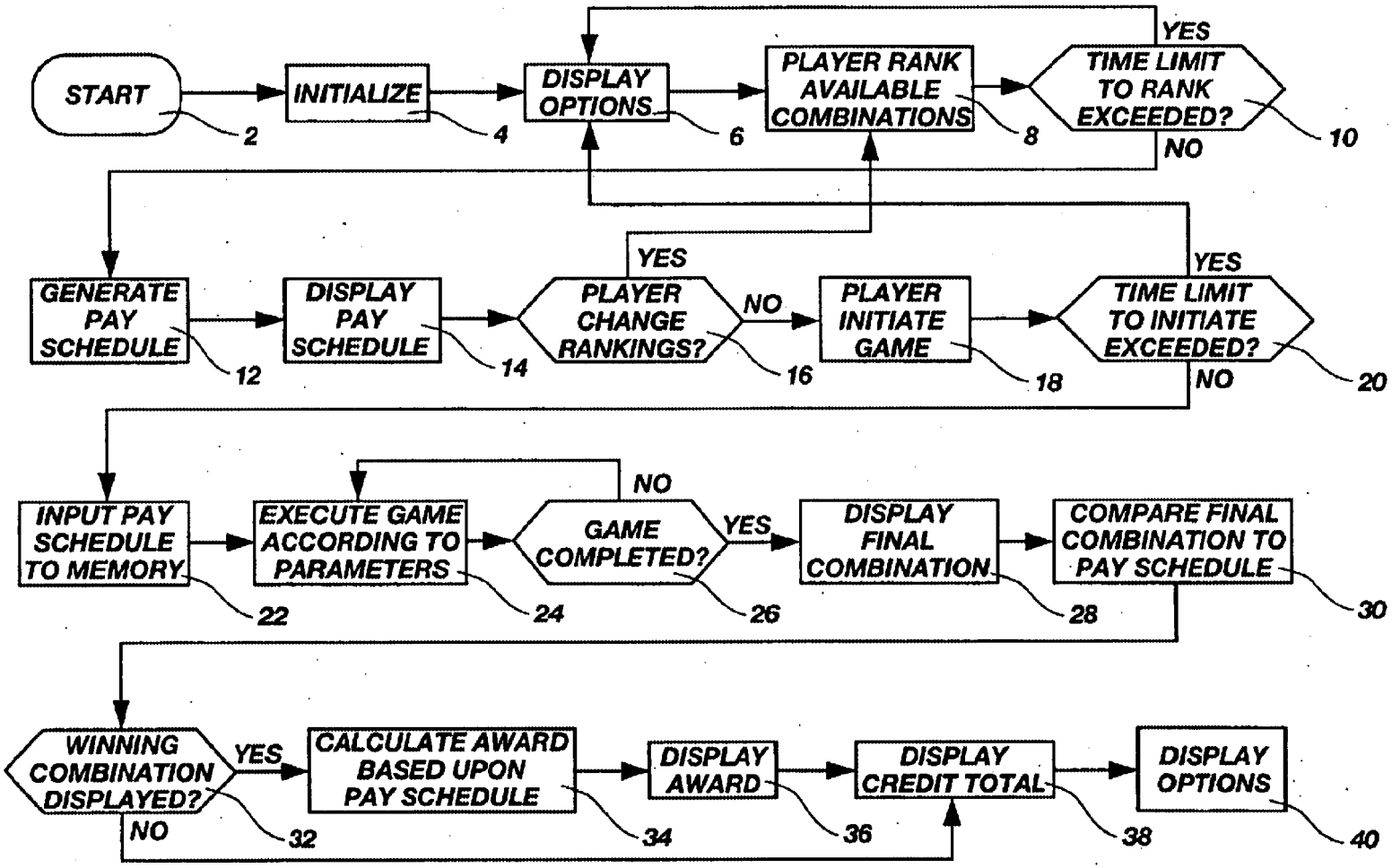
FIG. 4 is a flow chart diagram according to a first embodiment of the first aspect of the present invention.

FIG. 4 is a flow chart diagram of a first embodiment of the first aspect of the present invention. According to this first embodiment, after the gaming machine is started 2 by tendering of a wager, the gaming machine initializes 4 and displays a player's options for playing the game 6. A player's options may include such items as, by example only: method of entering credits, cashing-out credits or winnings, selecting a particular game or game parameters, or any other option commonly associated with electronic gaming machines. For the embodiment described in FIG. 4, if a player chooses the appropriate options, the player may then rank, within a predetermined time period 10 (so as to keep the gaming machine in beneficial use), a plurality of available combinations or elements in whatever order the player desires. The ranking of combinations or elements determines the relative order of payout magnitude for each selected winning combination or element, the first ranked combination or element having the largest associated payout, the second ranked combination or element having the second largest associated payout, and so on, to the last ranked combination or element. The number of possible rankings (i.e., 1, 3, 5, 10, etc.) may be player selected or predetermined as part of the programmed parameters of the game. In other words, "ranking" according to the invention may comprise selecting only a single element or combination to trigger an award, to the exclusion of all other possible elements or combinations.

For example, a player may select a ranking of winning combinations in an electronic card game as follows:

1. Three of a Kind
2. Straight Flush
3. Full House

If such a ranking of winning combinations is selected, a pay schedule is generated 12 by the processor associated with the game, wherein the largest award is associated with a winning combination of Three of a Kind. The awards for Straight and Full House would be, respectively, no larger than Three of a Kind. As will be clear to one of ordinary skill in the art, the pay schedule generated responsive to these rankings may include awards or payouts for the second, or even the third or other ranked winning combinations, which are equal to the award assigned for the first ranked winning combination. This may occur, for example, when a combination with a higher probability of appearing (such as 2 Pair) is player-ranked higher than a combination with a relatively lower probability of appearing (such as Royal Flush).

By allowing a player to select the winning element or combination for which the player will receive the highest award, a player's interest in the game may be enhanced. The player is thus motivated to attempt to achieve one or more of the player's preferred combinations for a larger award rather than merely accept the preset, default combinations and award orders or rankings offered by a gaming machine. It is also contemplated that a gaming machine according to the present invention may further include one or more bonus winning combinations for which an award is paid in addition to the player's ranked combinations. For example and without limitation, in order to further stimulate interest in ranking winning combinations or elements, the microprocessor or other controller may be programmed to initiate a "roving" or "wild card" payout triggered by a selection by the player of a particular ranking scheme or format which is changed at random by the microprocessor over a period of time. Thus, the player is motivated to tender a wager and then initiate his or her own ranking scheme for the game, responsive to the possibility that the mere selection of the ranking scheme may trigger an immediate payout, or result in an enhanced, or multiplied, payout for hitting a selected, ranked winning combination of elements for one or more plays (as programmed) of the game.

Referring again to the embodiment described in FIG. 4, once the pay schedule is generated 12 by the processor associated with the gaming machine, the pay schedule is (optionally) displayed 14 and the player may be given the option to change the rankings 16 if the pay schedule is unacceptable. If the player accepts the rankings, the player may then initiate the game 18 by activating the game initiator (i.e., a button, pad or handle) within a predetermined time period 20. Once the player initiates the game 18 within the appropriate time period 20, the generated pay schedule with ranked winning elements or combinations and associated awards or payouts is transferred to memory 22 and the game continues to completion according to the game parameters 24. When the game has completed 26, the final combination is displayed 28 and compared to the pay schedule 30 to determine whether the final combination is a winning combination 32. As will be clear to one of ordinary skill in the art, some electronic gaming machines provide games where the final combination is determined from a single player action (i.e., a slot machine where a single pull of the handle provides the combination), and other electronic gaming machines provide games where the final combination is determined only after a series of interactions between the player and the game, or between multiple players (i.e., a card game where the player's final "hand" includes the final combination). If the player's final combination is a winning combination, the player's award is calculated based upon the pay schedule 34, the award is displayed 36, and the player's credit total is displayed 38. The player is then shown additional options 40 such as to continue play, change rankings, cash-out, and the like. It is also contemplated that initiation of a subsequent game without changing rankings may be effected automatically through activation of a game initiator as described above after application of credits. Toward that end, the player may be prompted by the gaming machine to either play the game as previously configured or initiate a new configuration. Moreover, the gaming machine may be programmed to offer and prompt the options of accepting a preconfigured ranking for those not wishing to initiate their own, a ranking entered by a prior player and retained in memory, or of initiating one's own ranking configuration.

As used herein in conjunction with electronic gaming machines and the storage of data therein, including pay schedules with ranked elements and combinations of elements with associated awards, the term "memory" means and includes, by way of example and without limitation, any memory media, whether magnetic, electronic, optical or combinations thereof, applicable to a given, intended data storage purpose, whether short or long term, as the case may be. For example, and without limitation, memory means and includes EPROM's, EEPROM's, DRAMs, SRAMs, magnetic disc memory (hard or floppy), CD-ROMS (readable only and read/write), optical mini-discs, as well as so-called "firmware" with embedded data.

Figure 5:
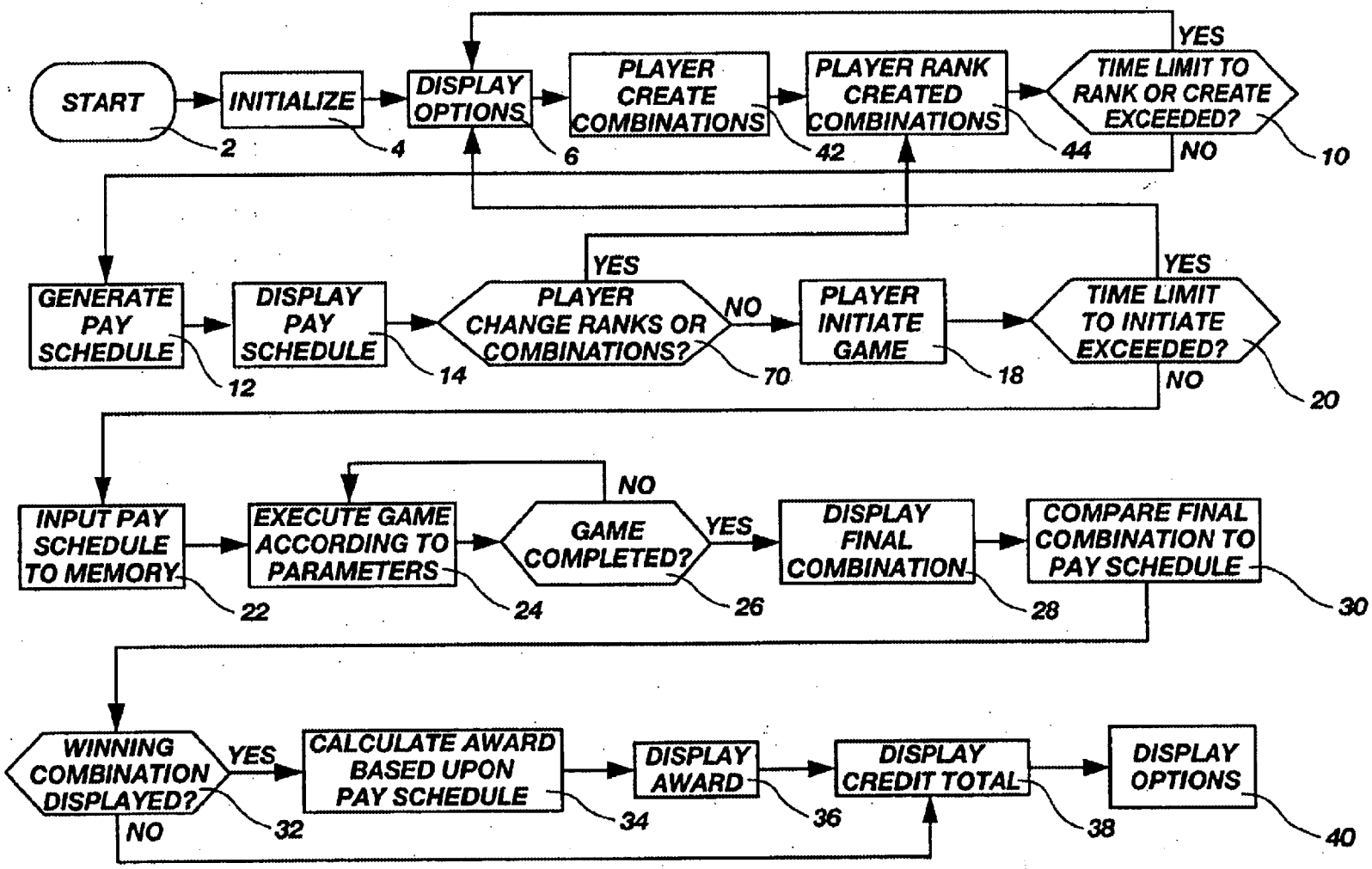
FIG. 5 is a flow chart diagram according to a second embodiment of the first aspect of the present invention.

As illustrated in FIG. 5 in a second embodiment of the first aspect of the present invention, a player creates the winning combinations from available elements and then ranks those selected winning combinations. Features previously identified with respect to FIG. 4 are identified for convenience and clarity with the same reference numerals in FIG. 5. Rather than merely ranking "standard" available combinations as shown and described with reference to FIG. 4, a player playing the gaming machine of the embodiment of FIG. 5 may actually create the winning combinations 42 to be used for generating the pay schedule. For example, if a player playing a slot machine would rather be rewarded for a single cherry, a single bar and a single seven appearing on the same line rather than three cherries, three bars or three sevens, a player could create a winning combination including the desired combination of elements. Similarly, if a player playing a poker game would like to be rewarded for having a final winning combination including a two, a four, a six, an eight and a ten of a single suit or various suits rather than a royal flush, a straight or a full house, the player may so choose. The player may then rank the created winning combinations 44 in a way such as that previously described in reference to FIG. 4. Further, the player may change the ranks or the created combinations 70 after the pay schedule is displayed if the information displayed is unacceptable. In operation, the processor associated with the game may then determine the probabilities of appearance for the various created winning combinations, and generate a pay schedule in response to the determined probabilities and the rankings chosen by the player.

Figure 6:
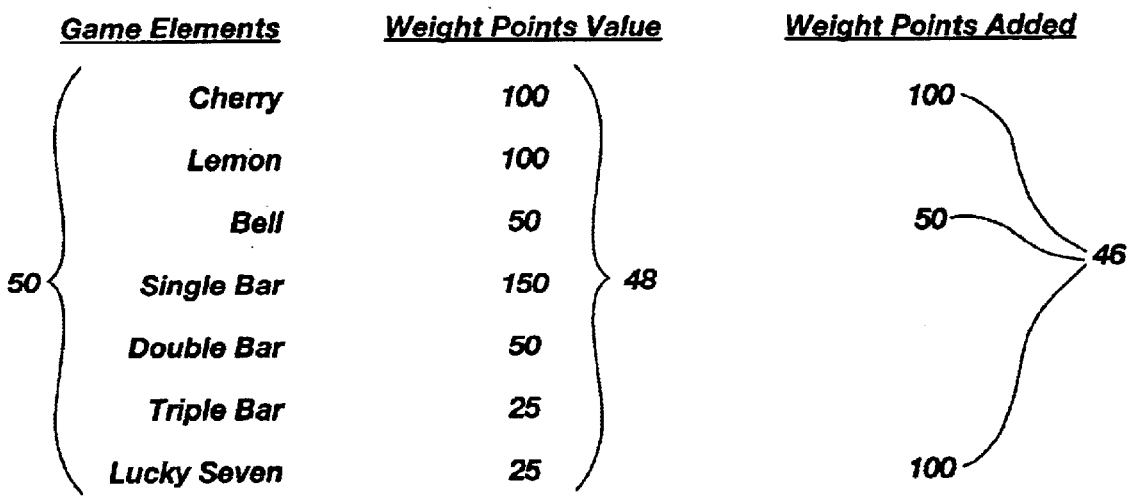
FIG. 6 is a table of weight points illustrating the capacity of a gaming machine to accept additional weight points, according to a first embodiment of the second aspect of the present invention.

According to a second aspect of the present invention, a player may adjust the odds that a particular game element or winning combination will appear, thereby allowing a player to adjust the frequency with which a particular combination will show. By giving a player control over the probability of one or more winning elements or combinations appearing, a player's interest in the game and desire to play the game may be enhanced. In one embodiment of this second aspect of the present invention, a player may directly or indirectly adjust the probability that a particular element will appear among a mix of elements by adjusting the weight assigned to one or more elements in the game. As shown in FIG. 6, in a gaming machine configured according to this first embodiment of the second aspect of the invention, a player may be granted a predetermined quantity of weight points 46 (such as, by way of example only, the 250 weight points employed in FIG. 6) which the player may add to the existing weight points value 48 of one or more elements 50 in the game. Although FIG. 6 shows only game elements, it is contemplated that a gaming machine may, alternatively or additionally, be configured to allow a player to adjust the probabilities or weight points value for selected combinations. In other words, various combinations of more heavily weighted, although different, individual elements may be induced to appear more frequently due to the heavier weighting of the individual component elements themselves. Of course, heavily weighting only a single element will also result in more frequent appearance of that element in combination, such as three cherries, etc.

As will be clear to one of ordinary skill in the art, in another embodiment a player may also directly adjust the weight points values 48 for one or more elements 50 or combinations in the game by changing their preset values rather than merely separately adding a predetermined number of weight points. For example, and with reference to FIG. 6, if a player has a fascination with a "lemon" element, he or she may remove (by way of example only) 50 weight points from the "cherry" element and add them to the "lemon" element so that the "cherry" element is weighted at 50 points while the "lemon" element is weighted at 150 points. In this way, if a player has a preference for viewing a particular element, or for achieving a particular combination, the player may adjust the weight points for that element or resulting combination of elements so that the element or combination appears more frequently. For simplicity, movement of points may be restricted to preset increments such as 10 weight points or 25 weight points, or free movement of weight points in any player-selected value may be permitted.

Additionally, rather than adding a quantity of weight points 46 to the weight points value 48 of each element 50, a gaming machine may be configured to have a predetermined total number of weight points available, such as 100 weight points, and allow a player to arrange and distribute the weight points among the various elements in the player's preferred arrangement. This configuration would grant the player even more perceived control over the probabilities of appearance of game elements and combinations. A pay schedule including appropriate award or payout amounts may be generated by a processor associated with the gaming machine of this first embodiment of the second aspect in response to the respective weight points relationships among the elements.

In a second embodiment of the second aspect of the present invention, a gaming machine is configured to allow a player to adjust the probabilities of elements appearing by adding one or more selected elements to the total mix of elements. For example, if a player is playing an electronic card game or other game using face card images as the elements for the game, the game may be configured to display a virtual "deck" having a standard 52 cards. The player may then be provided with an option to select one or more cards to add to the virtual "deck" such that there is a higher probability for the added card or cards to appear than the other cards of the deck. For example, if a player adds a second Queen of Hearts to a standard deck, the probability of the Queen of Hearts appearing in the augmented deck is 2/53 (3.77%), while the probability of a Queen of Hearts appearing in a standard deck is only 1/52 (1.92%). Increasing the probability of an element appearing, respectively increases the probability that a combination including that element will appear.

According to a third embodiment of the second aspect of the present invention, rather than adjusting the probability that a particular element or combination will appear by adjusting the weight points assigned to the element or combination, or adding one or more elements to the entire mix, the probabilities are directly set by the players. A gaming machine is configured such that a player, given 100% probability total, may assign a portion of the percentage to each element or combination in the total mix of elements or combinations. In this way, a player may directly and simply control the probability of a particular element or combination appearing. For each of the embodiments of this second aspect of the present invention, a processor associated with the gaming machine generates a pay schedule in response to the player's adjustments to the probabilities of appearance.

According to a third aspect of the present invention, a player is provided with an option to select an award amount for one or more winning elements or combinations. In response to the player's selection, a processor associated with the gaming machine generates an appropriate pay schedule. As discussed previously, a processor to generate an appropriate pay schedule may be configured by one of ordinary skill in the art. However, for further clarity, the following discussion is provided. If a player selects a relatively high award value for a particular winning combination, the award values associated with other winning elements or combinations in a pay schedule may be decreased to maintain the house's take from the gaming machine. Alternatively or additionally, the probabilities that a particular winning element or winning combination will appear may be altered to enable the chosen award amount to be granted in the pay schedule. Of course, award limits may also be established to ensure that award amounts are not so excessive as to make calculation of an appropriate pay schedule too difficult.

Figure 7:
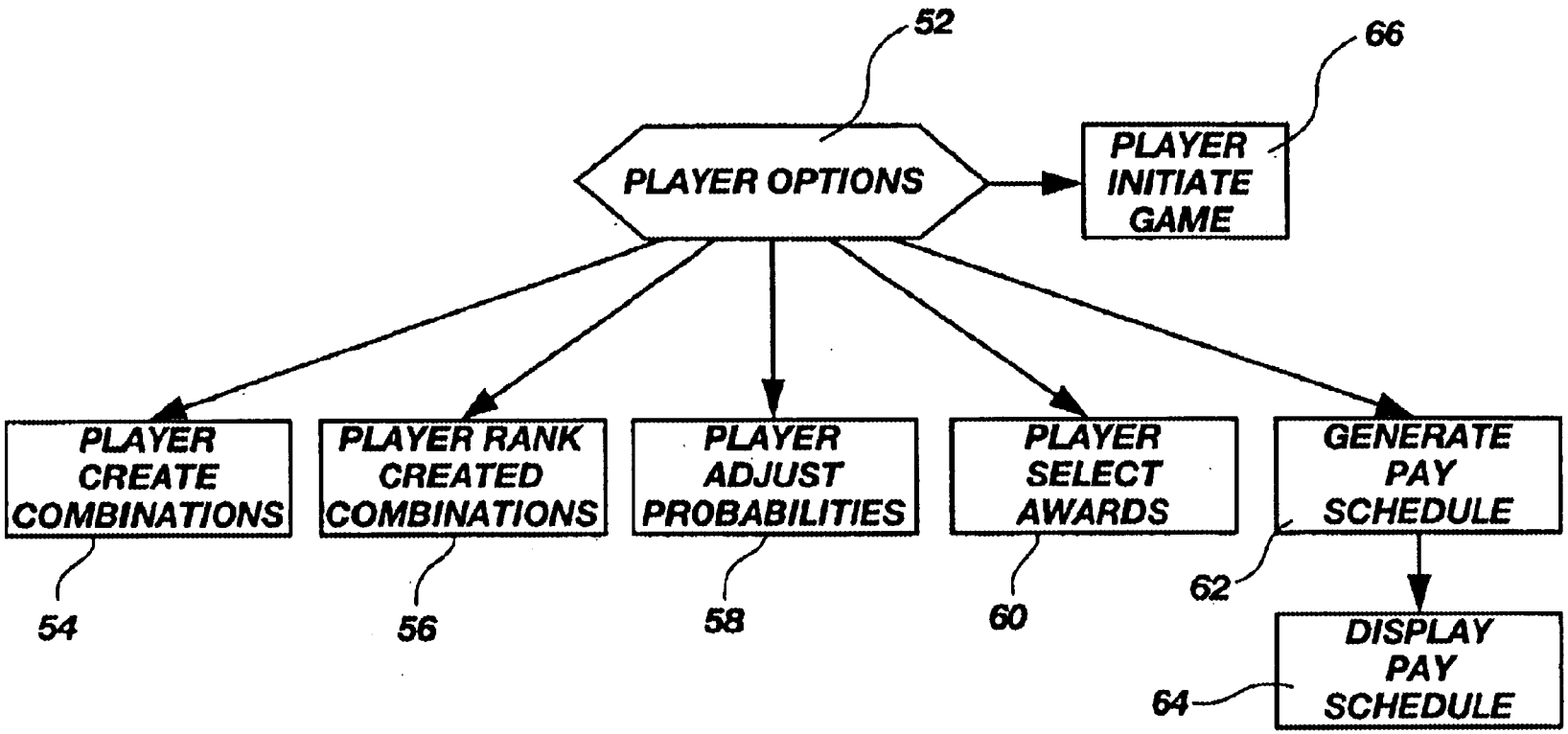
FIG. 7 is a chart illustrating player options in an electronic game configured according to one or more embodiments of the present invention.

One of ordinary skill in the art will appreciate how to combine one or more embodiments and aspects of the present invention to create other gaming machines. By way of example only, as illustrated by the chart of FIG. 7, a gaming machine may be configured to provide a player options 52 for creating one or more winning combinations 54 and ranking those combinations 56 for awards, adjusting the probabilities 58 that one or more elements or combinations will appear, and selecting one or more award values 60, such as the award value for a jackpot award. After entering the desired parameters for a pay schedule, a player may select the option to have the processor generate the completed pay schedule 62, or the pay schedule may be automatically generated upon completion of all possible selections or indication by the player that certain selections are not desired. Thereafter, the pay schedule is optionally displayed 64 for player approval. If a player finds a generated pay schedule acceptable, the player may then initiate the game 66.

It is contemplated that pay schedules generated in response to a player's selections, or data sufficient to regenerate such pay schedules, may be saved for future playing in a local or networked database associated with the gaming machine, or on a portable memory device, such as a magnetic strip on an identification card, a smart card, or other device having the capacity to store data. With the pay schedule saved for future use, a player may initiate the desired, saved pay schedule configuration when initiating a gaming machine, thereby allowing more time for gaming with the desired pay schedule rather than requiring reentry of data. Similarly, weighting points distribution for a given type of game may be saved and downloaded from the portable memory device (or from the database responsive to activation by an identifier carried by the player or a personal code entered by the player) to any machine configured for that game and suitably programmed to accept and employ the data. In short, any of the embodiments disclosed herein, combinations thereof or of portions thereof, may be saved by the player as a player-selected preconfigured game for reuse at a subsequent time with a player-adaptable gaming machine according to the present invention.

While the present invention has been disclosed in the context of a single game offered by an electronic gaming machine, it will be understood and appreciated by those of ordinary skill in the art that the present invention also has applicability to those gaming machines offering so-called bonus or secondary games. In such an application of the present invention, and by way of example only and not limitation, a player may elect to reduce or even eliminate awards or payouts associated with winning combinations in the primary or basic game offered by the gaming machine in favor of enhanced awards or payouts in the bonus game, if and when reached by the player. Such an approach may be used simply as described in the preceding sentence, or used in combination with separate or combined selection and ranking of game parameters as previously described herein in each of the basic and secondary games offered by the gaming machine. The relative power and speed of state of the art microprocessors in combination with relatively inexpensive memory renders such approaches feasible and only limited by a desire to maintain some degree of simplicity for the player, to use the selection process to enhance the entertainment and, thus, attention-maintaining aspect of the game, and to consequently keep the electronic gaming machine in play for the generation of revenue.

Although the present invention has been shown and described with respect to preferred embodiments, various additions, deletions and modifications that are obvious to a person skilled in the art to which the invention pertains, even if not shown or specifically described herein, are deemed to lie within the scope of the invention as encompassed by the following claims.

What is claimed is:

1. A gaming apparatus comprising:

a display;

a credit acceptor;

a player-modification input device; and a processor operatively coupled to the display, the credit acceptor, the player-modification input device, and a memory, the processor programmed to receive a wager via the credit acceptor, the processor programmed to provide a game wherein a set of game elements is selected from a plurality of game elements, the set being associated with a list of sets with each set within the list of sets having a default ranking, the processor programmed to receive an input from the player-modification input device, the processor programmed to modify the ranking of at least one set from the default ranking for the at least one set according to the input, the processor programmed to modify a pay table associated with the game according to the modification of the ranking of the at least one set from the default ranking for the at least one set, the processor programmed to generate a first game outcome, the processor programmed to generate a first display according to the first game outcome, the processor being programmed to determine a game payout associated with the first game outcome and the modified pay table, and the processor being programmed to provide a bonus payout as a direct consequence of the modification of the ranking of the at least one set as opposed to another of the sets.

2. The gaming apparatus according to claim 1, wherein the bonus payout is a separate payout from the game payout.

3. The gaming apparatus according to claim 1, wherein the bonus payout is a multiplier, the processor being programmed to multiply the game payout by the multiplier.

4. The gaming apparatus according to claim 1, wherein the processor is programmed to randomly choose the modification of the ranking of the at least one set that results in a bonus payout.

5. The gaming apparatus according to claim 1, wherein:

the processor is programmed to associate a bonus payout with a modification of a ranking of at least one of the sets from the default ranking to a specified non-default ranking;

the processor is programmed to receive an input from the player-modification input device;

the processor is programmed to modify the ranking of at least one set from the default ranking to the specified non-default ranking; and the processor is programmed to provide a bonus payout because the ranking of the at least one set has been modified from its default ranking to the specified non-default ranking.

6. The gaming apparatus according to claim 5, wherein:

the processor is programmed to associate a bonus payout with a modification of the rankings of first and second sets from their default rankings to specified first and second non-default rankings;

the processor is programmed to receive an input from the player-modification input device;

the processor is programmed to modify the rankings of first and second sets from their default rankings to the specified first and second non-default rankings; and the processor is programmed to provide a bonus payout because the rankings of the first and second sets have been modified from their default rankings to the specified first and second non-default rankings.

7. A gaming method comprising:

receiving a wager;

providing a game wherein a set of game elements is selected from a plurality of game elements, the set being associated with a list of sets with each set within the list of sets having a default ranking;

receiving a player input;

modifing the ranking of at least one set from the default ranking for the at least one set according to the player input;

modifying a pay table associated with the game according to the modification of the ranking of the at least one set from the default ranking for the at least one set;

generating a first game outcome;

generating a first display according to the first game outcome;

determining a game payout associated with the first game outcome and the modified pay table; and providing a bonus payout as a direct consequence of the modification of the ranking of the at least one set as opposed to another of the sets.

8. The gaming method according to claim 7, wherein the bonus payout is a separate payout from the game payout.

9. The gaming method according to claim 7, wherein the bonus payout is a multiplier, the processor being programmed to multiply the game payout by the multiplier.

10. The gaming method according to claim 7, comprising choosing randomly the modification of the ranking of the at least one set that results in a bonus payout.

11. The gaming method according to claim 7, comprising:

associating a bonus payout with a modification of a ranking of at least one of the sets from the default ranking to a specified non-default ranking;

receiving an input from the player-modification input device;

modifying the ranking of at least one set from the default ranking to the specified non-default ranking; and providing a bonus payout because the ranking of the at least one set has been modified from its default ranking to the specified non-default ranking.

12. The gaming method according to claim 11, wherein:

associating a bonus payout with a modification of the rankings of first and second sets from their default rankings to specified first and second non-default rankings;

receiving an input from the player-modification input device;

modifying the rankings of first and second sets from their default rankings to the specified first and second non-default rankings; and providing a bonus payout because the rankings of the first and second sets have been modified from their default rankings to the specified first and second non-default rankings.

* * * * *